US007090008B2

(12) United States Patent
Read

(10) Patent No.: US 7,090,008 B2
(45) Date of Patent: Aug. 15, 2006

(54) SYSTEM TO CONNECT CONDUIT SECTIONS IN A SUBTERRANEAN WELL

(75) Inventor: Barry A. Read, Bournemouth (GB)

(73) Assignee: Sensor Highway Limited (GB)

( * ) Notice: Subject to any disclaimer, the term of this patent is extended or adjusted under 35 U.S.C. 154(b) by 70 days.

(21) Appl. No.: 10/447,595

(22) Filed: May 29, 2003

(65) Prior Publication Data

US 2004/0238182 A1 Dec. 2, 2004

(51) Int. Cl.
*E21B 17/06* (2006.01)
*E21B 23/00* (2006.01)

(52) U.S. Cl. ..... 166/242.6; 166/378; 166/380

(58) Field of Classification Search ..... 166/378, 166/380, 381, 242.3, 242.6, 242.1, 242.7; 285/123.1, 123.2, 123.17
See application file for complete search history.

(56) References Cited

U.S. PATENT DOCUMENTS 5,526,888 A * 6/1996 Gazewood ..... 175/320
6,213,206 B1 * 4/2001 Bakke ..... 166/242.7
6,460,900 B1 * 10/2002 Bakke ..... 285/330

* cited by examiner

*Primary Examiner*—Jennifer H. Gay
*Assistant Examiner*—Giovanna M Collins
(74) *Attorney, Agent, or Firm*—Trop, Pruner & Hu, P.C.; Bryan P. Galloway; Jaime A. Castano

(57) ABSTRACT

An apparatus that is usable with a subterranean well includes a latch and an engagement mechanism. The latch is adapted to form a releasable connection between a first conduit section and a second conduit section in response to engagement of an actuator of the latch and maintain a first distance between an end of the first conduit section and an end of the second conduit section. The engagement mechanism is adapted to continuously engage the actuator to cause the latch to connect the first conduit section and the second conduit section despite the movement of the engagement mechanism between a first position and a second position. The second distance between the first position and the second position is greater than the first distance.

30 Claims, 7 Drawing Sheets

SYSTEM TO CONNECT CONDUIT SECTIONS IN A SUBTERRANEAN WELL

BACKGROUND

The invention generally relates to a system to connect conduit sections in a subterranean well, and more particularly, the invention relates to a system to form a releasable connection between conduit sections and to limit movement of the conduit sections with respect to each other when connected together.

Several different conduit members typically are present in a subterranean well for purposes of communicating well fluids, hydraulic fluids, etc. Some of these conduit members may be formed from connected conduit sections. More particularly, one end of each conduit section may form a female connector, and the other end of the conduit section may form a male connector. The female connector of each conduit section mates with the male connector of an adjacent conduit section so that the conduit sections may be connected in an end-to-end fashion to form the tubular member. An example of a connection between two such conduit sections is depicted in FIG. 1.

Referring to FIG. 1, as an example, the connection may be formed from a female connector assembly 10 (that is attached to the upper end 21 of a lower conduit section 12) and the lower end 20 (forming a male connector) of an upper 14 conduit section. The connection is established by lowering the upper conduit section 14 downhole into the wellbore so that the lower end 20 of the upper conduit section 14 enters, or "stabs," an upper opening 19 of the female assembly 10.

As depicted in FIG. 1, for purposes of guiding the lower end 20 of the upper conduit section 14 into the female connector assembly 10, the assembly 10 may include such features as an inclined surface 11 (of an upper housing section 17 of the assembly 10) that is slanted toward the opening 19. Furthermore, for purposes of forming a seal between the upper 12 and lower 14 conduit sections, the female connector assembly 10 may include a seal assembly 18 that is contained within a middle section 15 of the assembly 10. The seal assembly 18 may include a stack of annular seals that reside between the exterior surface of the upper conduit section 14 and the interior surface of the middle section 15 of the female connector assembly 10. The seal between the conduit sections 12 and 14 exists only for the condition in which a gap d between the lower end 20 of the upper conduit section 14 and the upper end 21 of the lower conduit section 12 remains smaller than a specified distance (0.0250 inches, as an example). For a gap d greater than this specified distance, the integrity of the seal that is formed between the conduit sections 12 and 14 may be affected.

In a conventional well system, the conduit sections 12 and 14 may form part of a hydraulic conduit string that is used, as its name implies, for purposes communicating hydraulic fluid downhole. This hydraulic conduit string may be located inside or outside of a production tubing string (not shown) of the well. Thus, each conduit section 12,14 may be associated with and located inside or outside of a production tubing section (not shown). As a more specific example, the lower conduit section 12 may be located inside or outside of a lower production tubing section, and the upper conduit section 14 may be located inside or outside of an upper production tubing section. Adjacent production tubing sections (that form part of the production tubing string) may be connected together concurrently with the connection of the associated adjacent conduit sections (that form part of the hydraulic conduit string).

A potential difficulty with the above-described system is the criteria that for establishing an acceptable connection between the production tubing sections may be significantly different than the criteria for establishing an acceptable connection between the conduit sections 12 and 14. More specifically, the acceptable gap between adjacent ends of the production tubing sections may be significantly larger than the acceptable gap between the upper 20 and lower 21 ends of the conduit sections 12 and 14. By way of example, it may be acceptable for a gap of 0.75 inches or less (as an example, for comparison) to exist between the lower end of an upper production tubing section and the upper end of an adjacent lower production tubing section. This acceptable gap between production tubing sections may be significantly larger than the acceptable gap of 0.025 inches or less (as an example, for comparison) between the upper 20 and lower 21 ends of the conduit sections 12 and 14. Due to forces that are exerted on the conduit sections 12 and 14 by the production tubing sections, a movement between the production tubing sections may cause a relatively large movement (i.e., a movement greater than 0.025 inches, for example) between the adjacent ends of the conduit sections 12 and 14 and thus, may impair the seal between the conduit sections 12 and 14.

Thus, there is a continuing need for a better system for connecting tubular sections in a subterranean well.

SUMMARY

In an embodiment of the invention, an apparatus that is usable with a subterranean well includes a latch and an engagement mechanism. The latch is adapted to form a releasable connection between a first conduit section and a second conduit section in response to engagement of an actuator of the latch and maintain a first distance between an end of the first conduit section and an end of the second conduit section. The engagement mechanism is adapted to continuously engage the actuator to cause the latch to connect the first conduit section and the second conduit section despite the movement of the engagement mechanism between a first position and a second position. The second distance between the first position and the second position is greater than the first distance.

Advantages and other features of the invention will become apparent from the following drawing, description and claims.

DETAILED DESCRIPTION

Figure 1:
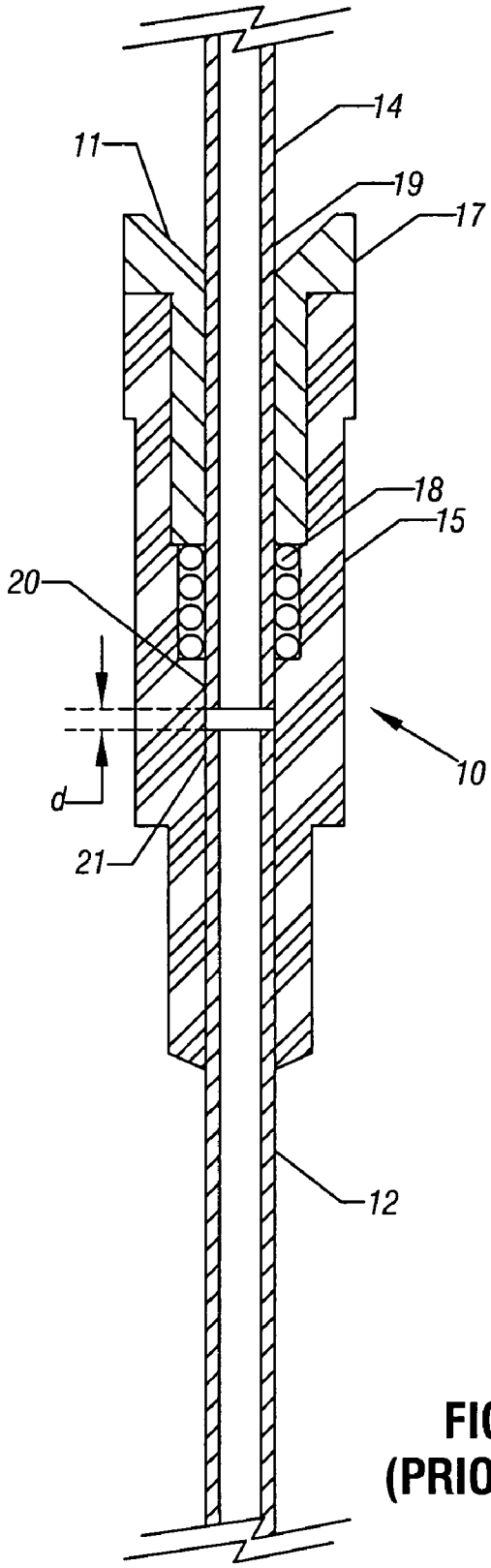
FIG. 1 (PRIOR ART)
FIG. 1 is a schematic diagram of a connection between conduit sections of the prior art.
Figure 2:
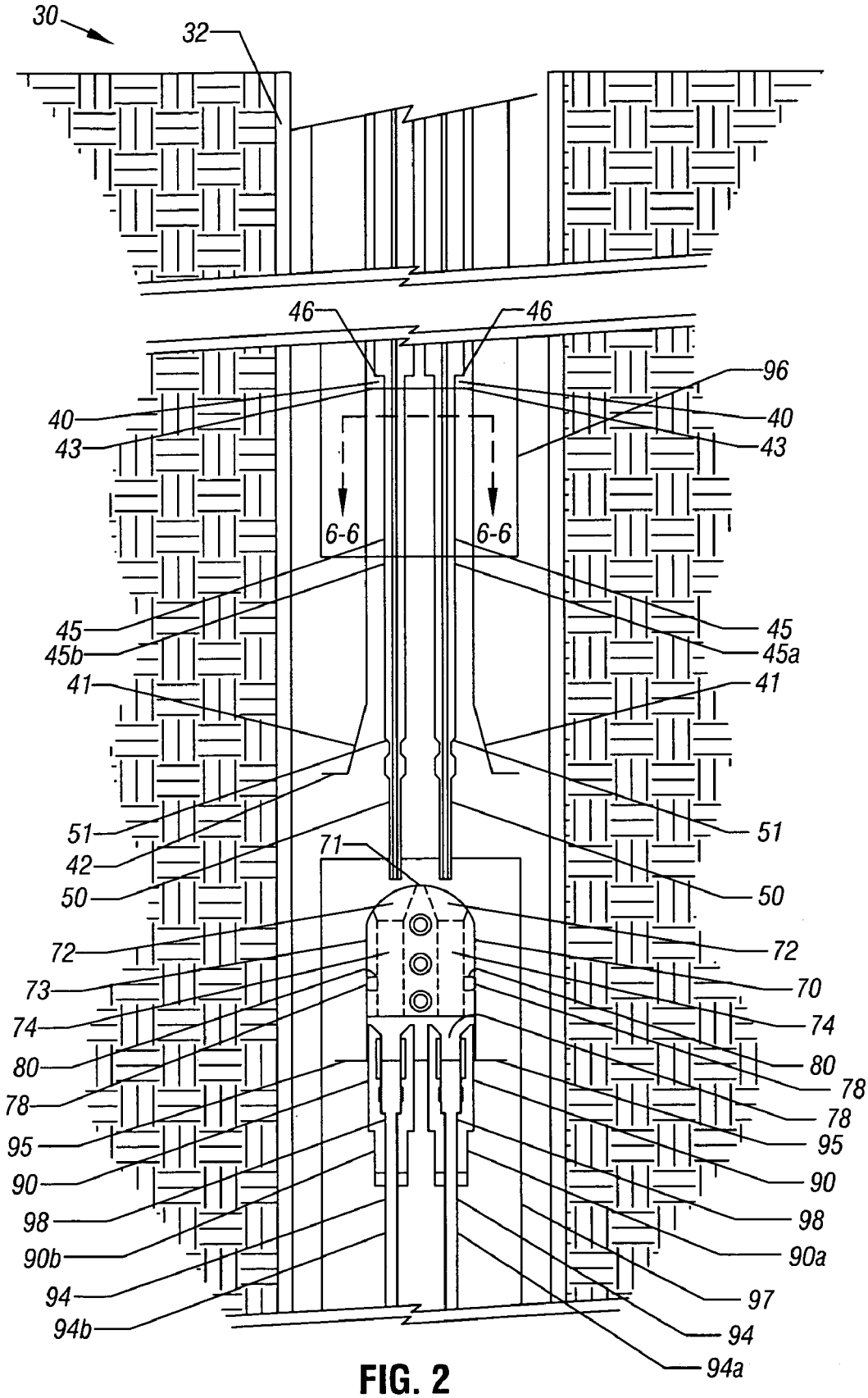
FIG. 2 is a schematic diagram of a system for connecting conduit sections according to an embodiment of the invention.

Referring to FIG. 2, an embodiment 30 of a system to releasably connect conduit sections together in a subterranean well in accordance with the invention includes a latch, such as a latch assembly 70. More specifically, the latch assembly 70 may be operated, as described below, to releasably secure lower conduit sections 94 (conduit sections 94*a* and 94*b*, depicted as examples) to corresponding upper conduit sections 45 (conduit sections 45*a* and 45*b*, depicted as examples) for purposes of creating portions of conduit strings (two hydraulic conduits, for example) within the well. In operation, the latch assembly 70 may be placed in an engaged state, a state in which the latch assembly 70 secures the conduit sections 45 and 94 together. The latch assembly 70 may also be placed in a disengaged state, a state in which the latch assembly 70 releases the conduit sections 45 and 94 so that the upper conduit sections 45 may be retrieved uphole and be separated from the lower conduit sections 94.

As a more specific example, when the latch assembly 70 is engaged, the assembly 70 sealably and mechanically connects the upper conduit section 45*a* to the lower conduit section 94*a*, and sealably and mechanically connects the upper conduit section 45*b* to the lower conduit section 94*b*. As described below, in this engaged state, the assembly 70 maintains the sealed connections between the upper 45 and lower 94 conduit sections by limiting the relative movement between the upper 45 and lower 94 conduit sections.

For purposes of placing the latch assembly 70 in its engaged state, the system 30 includes an engagement mechanism, such as a sleeve 40 (in accordance with some embodiments of the invention), that is generally coaxial with the longitudinal axis of the latch assembly 70. As described further below, after the lower end 50 of each upper conduit section 45 has been inserted into corresponding passageways of the latch 70, the lower end of the sleeve 40 slides over the outer surface of the latch assembly 70 to engage an actuator (described below) of the assembly 70 to place the assembly 70 in the engaged state.

Figure 6:
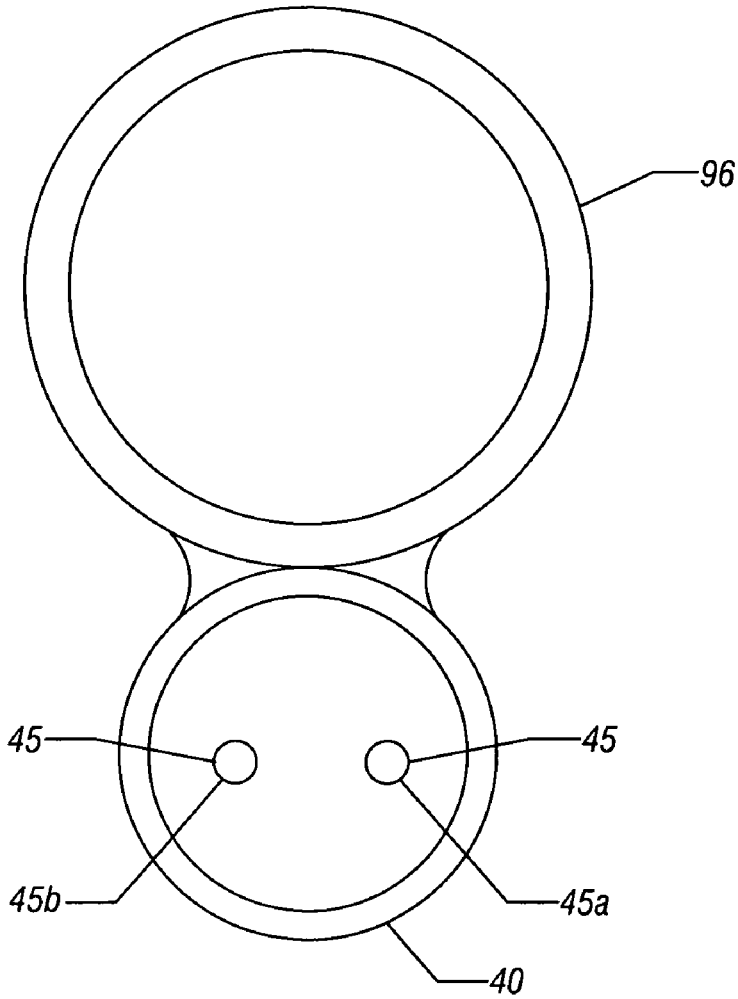
FIG. 6 is a cross-sectional view taken along line 6—6 of FIG. 2.

In some embodiments of the invention, the upper conduit sections 45 may extend along the outside of an upper production tubing section 96, and the lower conduit sections 94 may extend along the outside of a lower production tubing section 97. More specifically, the upper conduit sections 45 may be slidably connected to the sleeve 40, and the sleeve 40 may, in turn, be secured to the outside of the upper production tubing 96. The upper conduit sections 45 may be located inside the sleeve 40 in some embodiments of the invention. More specifically, referring also to FIG. 6, in some embodiments of the invention, the sleeve 40 may be eccentric with respect to the upper production tubing section 96. As shown in FIGS. 2 and 6 the upper conduit sections 45 have longitudinal axes that are generally parallel with the longitudinal axis of the upper production tubing section 96.

It is noted that in other embodiments of the invention, the orientation of the sleeve 40 with respect to the upper production tubing section 96 may be different from that shown in FIGS. 2 and 6. For example, in some embodiments of the invention, the sleeve 40 may be located inside the upper production tubing section 96. Furthermore, in some embodiments of the invention, the sleeve 40 may be concentric with the production tubing section 96 so that, depending on the particular embodiment of the invention, one of the upper production tubing section 96 and the sleeve 40 circumscribes the other. Other variations are possible.

Figure 5:
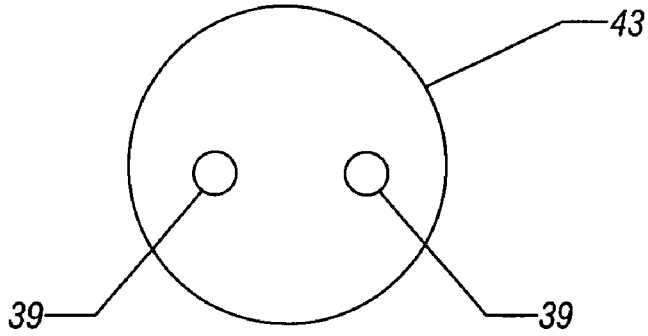
FIG. 5 is a top view of a plate of the system according to an embodiment of the invention.

Referring to FIG. 2, in some embodiments of the invention, the upper conduit sections 45 are located inside the sleeve 40 so that each upper conduit section 45 extends through a corresponding opening 39 (see also FIG. 5) in an inner plate 43 of the sleeve 40. The inner plate 43 is shown for the embodiment in which the sleeve 40 is eccentric to and located on the outside of the upper production tubing section 96. Each opening 39 (FIG. 5) of the inner plate 43 is sized to permit the conduit section 45 that extends through the opening to generally slide with respect to the sleeve 40. However, the downward movement of the upper conduit sections 45 relative to the sleeve 40 is limited by annular shoulders 46 of the upper conduits 45. More particularly, each upper conduit section 45 has an annular shoulder 46 that has an external diameter that is too large for the opening 39 of the plate 43 through which the upper conduit section 45 otherwise slides. Therefore, the upper conduit sections 45 may slide downwardly with respect to the sleeve 40 (and upper production tubing section 96 to which the sleeve 40 is secured) to a certain extent, with the length of travel of the upper conduit sections 45 being limited by the interactions of the shoulders 46 and plate 43. Therefore, due to the above-described arrangement, the sleeve 40, upper production tubing section 96 and upper conduit sections 45 may be lowered downhole together as a unit for purposes of forming connections with a lower production tubing section 97 and the lower conduit section 94. Similarly, for purposes of disconnecting the production tubing sections 96 and 97 and disconnecting the conduit sections 45 and 94, the sleeve, upper production section 96 and upper conduit sections 45 may be retrieved uphole together as a unit.

The ability of the upper conduit sections 45 to slide with respect to the sleeve 40 and upper production tubing section 96 permits 1. the upper conduit sections 45 to engage the latch assembly 70 (as described below) for purposes of forming connections and 2. once the conduit sections are connected together permits the upper production tubing section 96 to slide with respect to the upper conduit sections 45. This latter feature permits a greater degree of up and down travel between the upper production tubing section 96 and the lower production tubing section 97 relative to the degree of up and down travel that the latch assembly 70 permits between the upper 45 and lower 94 conduit sections.

Figure 3:
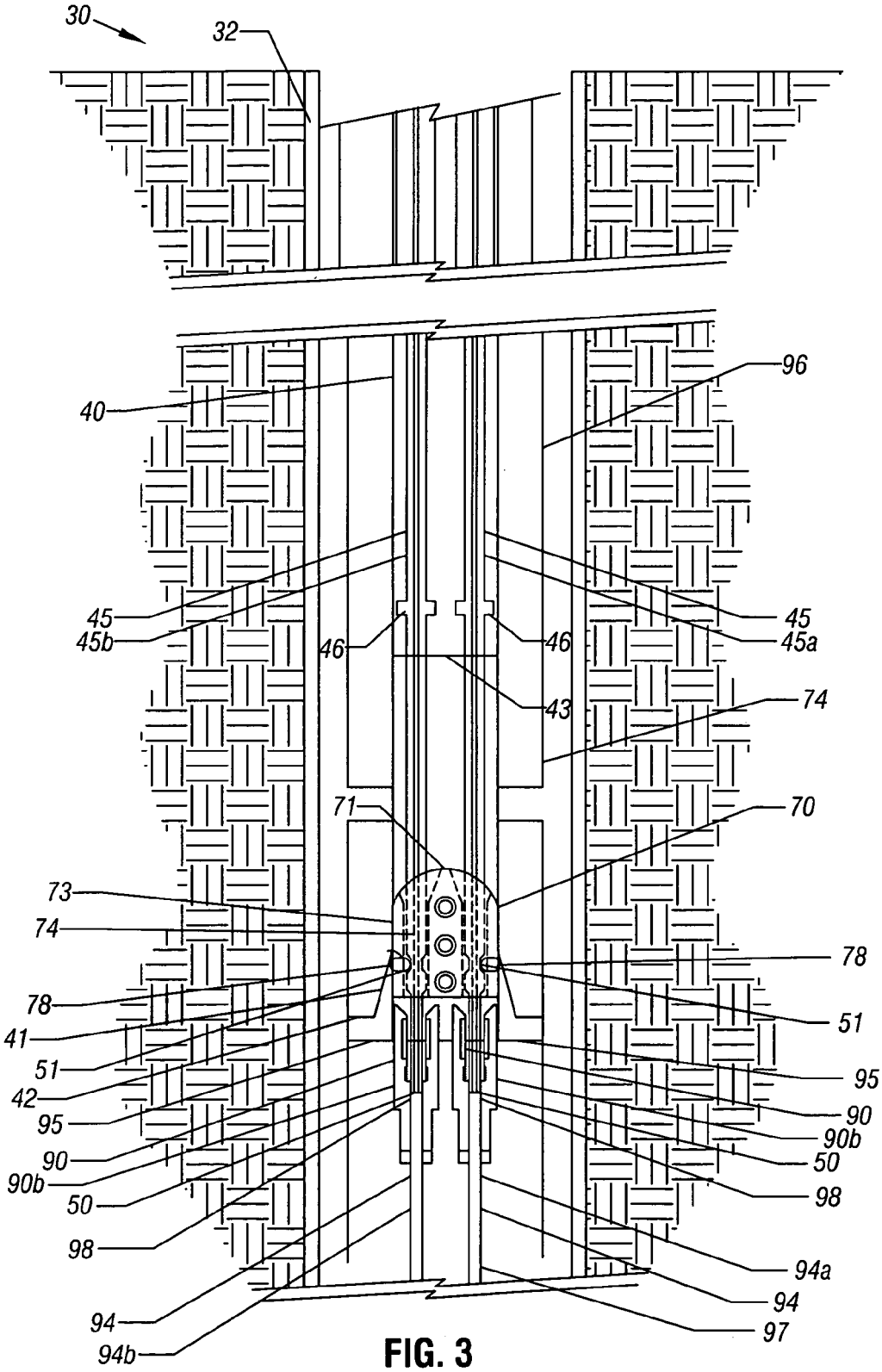
FIG. 3 is a schematic diagram of the system of FIG. 2 after connection of the conduit sections but before engagement of a latch to secure the connection between the conduit sections.

The latch assembly 70 is secured to the lower production tubing section 97 and may be located on the outside of the production tubing section 97, in some embodiments of the invention. As described below, in some embodiments of the invention, the assembly including the upper production tubing section 96, sleeve 40 and upper conduit sections 45 is lowered downhole until the upper conduit sections 45 slide into the latch assembly 70. Referring also to FIG. 3, in this downward descent, when the upper conduit sections 45 stop moving relative to the upper production tubing section 96 and the sleeve 40, the section 96 and sleeve 40 move downwardly with respect to the upper conduit sections 45. Eventually, the sleeve 40 engages the actuator of the latch assembly 70 (to lock the upper conduit sections 45 in the latch assembly 70) and the upper production tubing section 96 mates with the lower production tubing section 97, as depicted in FIG. 4.

Figure 4:
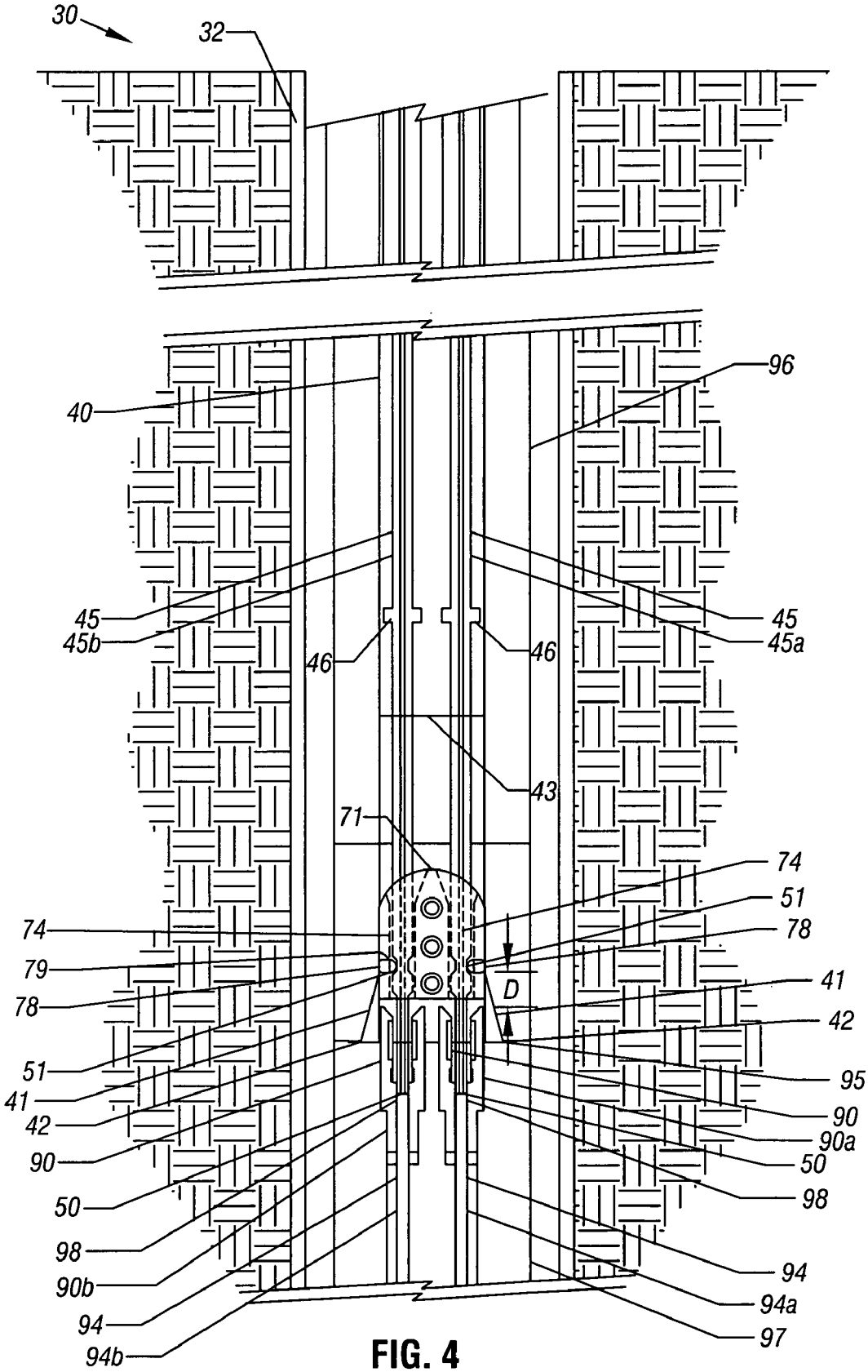
FIG. 4 is a schematic diagram of the system of FIG. 2 depicting engagement of the latch to secure the conduit sections together.

Referring to FIG. 4, when the actuator of the latch assembly 70 is engaged to secure the upper 45 and lower 94 conduit sections together a gap exists between the lower surfaces of the annular shoulders 46 and the plate 43. This gap, in turn, permits the upper production tubing section 96 to slide with respect to the lower production tubing section 97 and also permits the upper production tubing section 96 to slide with respect to the upper conduit sections 45. This ability for the upper production tubing section 96 to slide relative to the upper conduit sections 45 prevents the upper production tubing section 96 from exerting a hard force on the latch assembly 70 that may otherwise break the latch assembly 70.

The sliding of the upper production tubing section 96 with respect to the upper conduit sections 45, however, may produce frictional forces that may tend to force the conduit sections 45 and 94 (when connected) apart. However, as described below, the connection that is formed by the latch assembly 70 limits the degree of movement between the upper 45 and lower 94 conduit sections to preserve seal integrity between these sections 45 and 94. As a more specific example, in some embodiments of the invention, the connection that is formed by latch assembly 70 ensures that the lower end 50 of each upper conduit section 45 does not move beyond 0.025 inches from the upper end 98 of the associated lower conduit section 94. Other travel limits are possible.

In some embodiments of the invention, the upper 96 and lower 97 production tubing sections may form portions of a production tubing that extends into the well. In some embodiments of the invention, the upper 45 and lower 94 conduit sections may form portions of two hydraulic conduit strings that extend into the well inside or outside of the production tubing string. As a more specific example, in some embodiments of the invention, one or both hydraulic conduit strings may be used for purposes of pumping an optical fiber downhole via fluid drag, as described further in U.S. Reissue Pat. No. 37,283.

Although only one latch assembly 70 is depicted in the figures, it is understood that one latch assembly may be located at the union of each conduit section in the assembled hydraulic conduit string. Furthermore, although portions of two hydraulic conduit strings are depicted in the figures, it is understood that a single hydraulic conduit string or more than two hydraulic conduit strings may be installed downhole via the latch assembly 70 at each conduit section connection.

The two hydraulic conduit string arrangement that is depicted in FIG. 2 may be used for purposes of establishing a U-shaped conduit in which the lower ends of the hydraulic conduit strings are connected together (not shown in FIG. 2) so that fluid may be pumped downhole through one hydraulic conduit string and return uphole through the other hydraulic conduit string. Such an arrangement is advantageous for pumping an optical fiber downhole via fluid drag, as described further in U.S. Reissue Pat. No. 37,283.

The optical fibers referred to herein may be used for purposes of forming a distributed temperature measurement (DTS) system and/or a Fiber Bragg Grating temperature measurement system, as described in U.S. patent application Ser. No. 10/317,556; and U.S. Pat. Nos. 5,798,521 and 6,246,048, as just a few examples.

In some embodiments, of the invention, the lower end of the upper production tubing section 96 may have a male connector (not shown) that stabs a female connector in the upper end of the lower production tubing section 96. The upper production tubing section 96 may have a tendency to significantly move (relating to movement between an upper conduit section 45 and a lower conduit section 94 to which the section 45 is connected) with respect to the lower production tubing section 97 after the two sections 96 and 97 are joined together. Furthermore, because, in some embodiments of the invention, the sleeve 40 is attached to or is part of the upper production tubing section 96, longitudinal movement of the upper production tubing section 96 may cause a corresponding longitudinal movement in the sleeve 40.

As a more specific example, the upper production tubing section 96 may be part of a seal bore so that the upper production tubing 96 (and thus the sleeve 40) may significantly move with respect to the lower production tubing 97 after the production tubing sections 96 and 97 mate and the conduit sections 45 and 94 mate. As another example, the upper production tubing 96 may be coiled conduit that has sufficient slack in the wellbore to permit the upper production tubing 96 to significantly move within the wellbore. Other variations are possible. The production tubing sections 96 and 97 maintain their connections even with this movement. As described above, the movement of the upper production section 96 tends to exert forces on the upper conduit sections 45, and these forces may be directed to separating the upper conduit sections 45 from the lower conduit sections 94.

However, regardless of the degree in which the production tubing sections 96 and 97 move relative to each other, the latch assembly 70, in its engaged state, limits movement of the upper 45 and lower 94 hydraulic conduit sections, relative to each other.

In some embodiments of the invention, the latch assembly 70 is generally attached to the upper ends of the lower conduit sections 94. The latch assembly 70 may be formed from a generally circularly cylindrical housing 73 that is coaxial with the longitudinal axis of the well. The housing includes a generally dome-shaped top surface 71 that includes two openings 72, each of which receives the lower end 50 of one of the upper conduit sections 45. Each opening 72 provides an entry port into an associated longitudinal passageway 74 of the latch assembly 70. Thus, each longitudinal passageway 74 receives the lower end 50 of one of the upper conduit sections 45 when the upper sections 45 are lowered into the latch assembly 70. As depicted in FIG. 2, for each longitudinal passageway 74, the latch assembly 70 includes at least one associated radial passageway 80 that intersects the passageway 74. Each radial passageway 80, in turn, provides a path for an associated actuator, or dog 78, to move inside the longitudinal passageway 74.

When the latch 70 is not engaged (FIG. 2 or 3), each dog 78 is located entirely outside of the passageway 74 so that in this position, an exterior surface of the dog 78 protrudes slightly beyond the general outer cylindrical surface of the housing 73. Due to the absence of each dog 78 from its associated passageway 74, the passageway 74 is unobstructed for purposes of allowing the lower end 50 of the upper conduit section 45 to pass through the passageway 74 into an associated female connector 90 (female connectors 90*a* and 90*b*, depicted as examples), described below.

Each female connector 90 guides the lower end 50 of the upper conduit section 45 into an associated lower conduit section 94. In some embodiments of the invention, the female connectors 90 may be part of the latch assembly 70. In some embodiments of the invention, each passageway 74 is coaxial with a central passageway 91 of the associated female connector 90. Each female connector 90, in turn, is connected to the upper end 98 of the associated lower conduit section 94. The female assembly 90 receives the lower end 50 of the upper conduit section 45 and includes seals that closely circumscribe the lower end 50 to form a sealed connection between the upper conduit section 45 and the lower conduit section 90. When the two conduit sections 45 and 94 meet inside the female connector 90, the upper 45 and lower 94 conduit sections may move apart by a relatively small distance, and the latch assembly 70 controls this distance to ensure that the gap between the mating ends of the upper 45 and lower 94 conduit sections does not exceed a predetermined maximum distance (a 0.025 inch maximum distance, for example) apart. Regulating this gap to ensure the gap does not exceed a certain distance maintains the integrity of the sealed connection between these conduit sections. In embodiments of the invention in which an optical fiber is pumped through the conduit that is formed the conduit sections 45 and 94, at least one of the reasons to confine the gap to a maximum distance and preserve seal integrity is to ensure proper pumping of the optical fiber.

Because the conduit sections 45 and 94 are slidably connected to production tubing sections, relative movement of these production tubing sections may impart separation forces on the conduit sections 12 and 14, and these forces may move the hydraulic sections farther apart, if not for the securement of the conduit sections by the latch assembly 70. More specifically, it may be acceptable for the production tubing sections 96 and 97 to move a relatively larger distance apart (0.075 inches, for example), as compared to the acceptable distance by which the ends 50 and 98 of the conduit sections 45 and 94 may be separated. Therefore, relative movement of the production tubing sections 96 and 97 with respect to each other may, if not for the features of the latch assembly 70, cause an undesirable separation between the conduit sections 45 and 94.

To limit any potential travel, or separations between the conduit sections 45 and 94, in some embodiments of the invention, the lower end 50 of the upper conduit section 45 includes a profile, or notch 51, that is engaged by one or more dogs 78 of the latch assembly 70 when the lower end 50 of the upper conduit section 45 is lowered into the corresponding passageway 91 of the female connector 90 and the latch assembly 70 is engaged, as depicted in FIG. 3.

FIG. 3 generally depicts the insertion of the lower ends of the upper conduit sections 45 into the female connectors 90 before the mating of the production tubing sections 96 and 97. As shown, when full insertion occurs, each notch 51 is located in a position such that a corresponding dog 78 is in a radially outward position from the notch 51. As can be appreciated from FIG. 3, in some embodiments of the invention, the profile of the interior surface of each dog 78 generally conforms to the profile of the notch 51.

The dogs 78 are each biased to remain outside of the passageway 74, and thus, the dogs 78 do not engage the notches 51 upon mere insertion of the upper conduit sections 45 into the female connectors 90. However, as depicted in FIG. 3, the sleeve 40 includes an inclined lower section 41 that has a diameter that increases with its downhole position. Thus, as can be seen from FIG. 3, as the sleeve 40 moves in a downward direction, the inner surface of the inclined section 41 exerts a radially inwardly directed force on each dog 78 to force each dog 78 inside the corresponding notch 51. The engagement of the dogs 78 in the notches 51, in turn, locks the upper conduit sections 45 in place with respect to the latch assembly 70 and the lower conduit section 94.

Referring to FIG. 4, at its lowest point of travel, a radially extending flange 42 of the sleeve 40 contacts a radially extending flange 95 of the latch assembly 70. At this point, the inclined section 41 of the sleeve 40 has transitioned past the dogs 78 so that the sleeve 40 now closely circumscribes the dogs 78 to force the dogs 78 fully into the notches 51 to engage the latch assembly 70.

As depicted in FIG. 4, to release the dogs from the notches, the sleeve 40 must move by a distance D, a distance that is much greater than the acceptable distance for the upper production tubing section 96 to move with respect to the lower production tubing section 97 to maintain a proper connection between. Due to this arrangement, the latch assembly 70 accommodates a wide variation of movement between the upper and lower production tubing sections while maintaining a locked connection between the upper 45 and lower 94 hydraulic conduit sections.

To disengage the latch assembly 70, an upward force is exerted on the upper production tubing section 96 from the surface of the well, and the production tubing section 96 is moved upwardly to raise the sleeve 40 also in an upwardly direction. This state is generally depicted in FIG. 3. Eventually, the sleeve 40 is raised past the distance D to allow the dogs 78 to radially expand to release the grip of each dog 78 on the corresponding notch 51. The sleeve 40 continues to travel in an upward direction (due to the upper travel of the production tubing section 96), and at some point, the plate 43 engages the annular shoulders 46 to lift the bottom ends 50 of the upper conduit sections 45 out of the latch assembly 70, as depicted in FIG. 2.

Other variations are within the scope of the following claims. For example, in some embodiments of the invention, the hydraulic conduits, latch assembly 70 and sleeve 40 may be located inside the production tubing. As another example, in some embodiments of the invention, the locking of the latch assembly may be performed in response to power that is supplied by an external power source, instead of occurring in response to a mechanical action.

Figure 7:
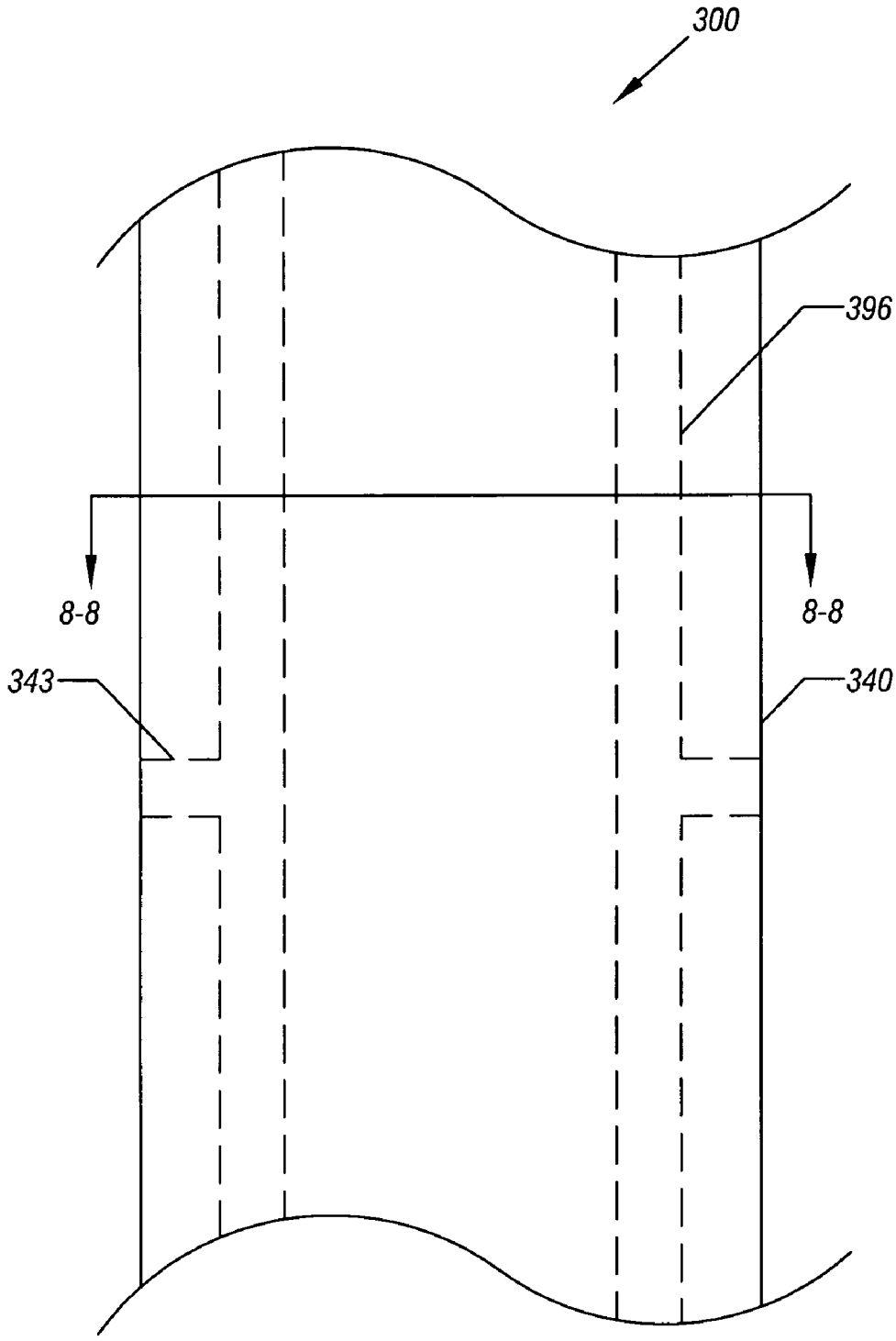
FIG. 7 is a schematic diagram of a portion of the sleeve and upper production tubing section according to another embodiment of the invention.
Figure 8:
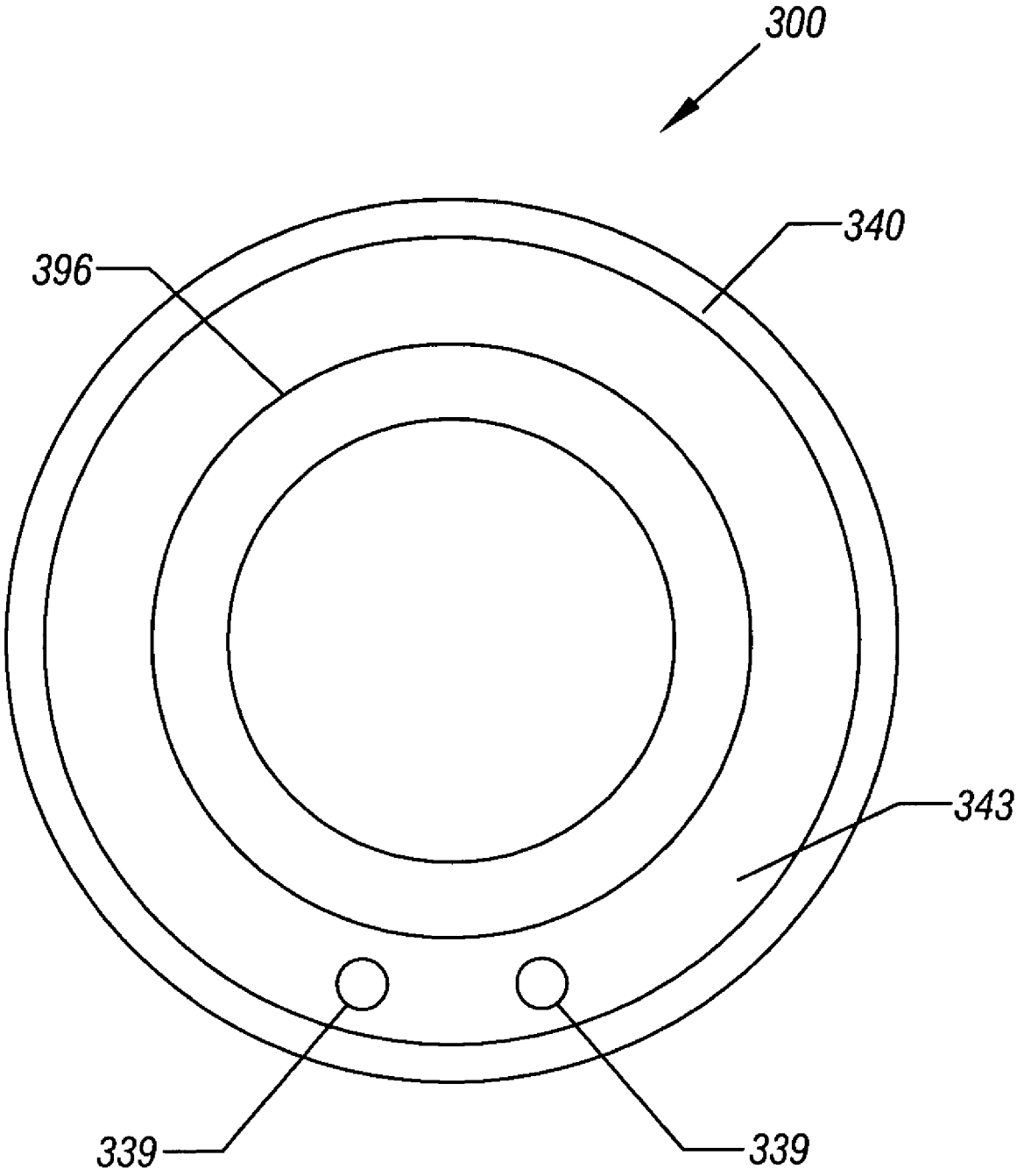
FIG. 8 is a cross-sectional view taken along line 8—8 of FIG. 7.

As another example of another embodiment of the invention, FIG. 7 depicts an arrangement 300 in which an upper production tubing section 396 replaces the upper production tubing section 96 and a sleeve 340 replaces the sleeve 40. The sleeve 340 is concentric with and circumscribes the upper production tubing section 396. This arrangement 300 also includes an annular plate 343 that radially extends between the exterior of the upper production tubing section 396 and the interior of the sleeve 340. In some embodiments of the invention, the annular plate 343 may be secured to both the sleeve 340 and the upper production tubing section 396 to secure these entities together. Referring also to FIG. 8, the annular plate 343 includes openings 339 to receive the upper conduit sections 45 (not shown in FIGS. 7 and 8). Similar to the openings 39 of the plate 43, the openings 339 of the plate 343 are sized to catch the shoulders 46 of the upper conduit sections 45 to limit downward travel of the upper conduit sections 45 relative to the sleeve 340 and upper production tubing section 396.

Although orientational terms such as "up," "down," etc. may have been used for purposes of simplifying the preceding discussion, it is understood that other orientations of the system 30 are possible. For example, although a vertical well is depicted in the drawings, it is understood that the system 30 may be used in a lateral wellbore, for example. Other variations are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. An apparatus usable with a subterranean well, comprising:

a latch adapted to form a releasable connection between a first conduit section and a second conduit section in response to engagement of an actuator of the latch, the first conduit section and the second conduit section being substantially parallel to a longitudinal axis of the latch and the latch being adapted to maintain a first distance of separation between an end of the first conduit section and an end of the second conduit section along the longitudinal axis; and an engagement mechanism adapted to continuously engage the actuator to cause the latch to connect the first conduit section and the second conduit section despite movement of the engagement mechanism between a first position and a second position, wherein a second distance between the first position and the second position along the longitudinal axis is greater than the first distance, wherein one of the first conduit section and the second conduit section is not inserted into the other of the first conduit section and the second conduit section when the latch forms the connection between the first conduit section and the second conduit section, wherein the engagement mechanism is connected to a first tubing section that forms a releasable connection with a second tubing section when the latch connects the first conduit section and the second conduit section.

2. The apparatus of claim 1, wherein the first tubing section and the second tubing section continuously maintain connection despite movement of the engagement mechanism between the first position and the second position.

3. The apparatus of claim 1, wherein the first tubing section and the second tubing section form part of a production tubing.

4. The apparatus of claim 3, wherein the first conduit section and the second conduit section form part of a hydraulic conduit tubing section.

5. The apparatus of claim 1, wherein the first conduit section receives a force tending to pull the end of the first conduit section away from the end of the second conduit section in response to movement of the engagement mechanism.

6. The apparatus of claim 5, wherein the force comprises a frictional force.

7. The apparatus of claim 1, wherein the first distance comprises a distance to maintain a seal integrity between the first conduit section and the second conduit section.

8. The apparatus of claim 1, wherein the engagement mechanism is connected to a first tubing section that forms a releasable connection with a second tubing section when the latch connects the first conduit section and the second conduit section, and wherein the first tubing section and the second tubing section form part of a production tubing.

9. The apparatus of claim 1, wherein the first conduit section and the second conduit section form part of a hydraulic conduit tubing section.

10. The apparatus of claim 1, wherein the engagement mechanism comprises a sleeve adapted to slide over the latch to engage the actuator.

11. The apparatus of claim 1, wherein the first distance comprises approximately 0.025 inches.

12. The apparatus of claim 1, wherein the actuator of the latch comprises:

at least one dog adapted to engage a locking feature of the first conduit section in response to contact between said at least one dog and the engagement mechanism.

13. The apparatus of claim 1, wherein the latch comprises:

a female connector attached to the end of the second conduit section and adapted to receive the first end of the first conduit section.

14. A method usable with a subterranean well, comprising:

using a moveable engagement mechanism to engage a latch to form a releasable connection between a first conduit section and a second conduit section;

maintaining a first distance between an end of the first conduit section and an end of the second conduit section such that one of the first conduit section and the second conduit section is not inserted into the other of the first conduit section and the second conduit section when the latch forms the connection between the first conduit section and the second conduit section;

attaching the engagement mechanism to a first tubing section that forms a releasable connection with a second tubing section when the first conduit section is connected to the second conduit section; and using the engagement mechanism to continuously engage the latch despite the engagement mechanism moving between a first position and a second position, wherein a second distance between the first position and the second position is greater than the first distance.

15. The method of claim 14, further comprising:

continuously maintaining a connection between the first tubing section and the second tubing section despite the engagement mechanism moving between the first position and the second position.

16. The method of claim 14, further comprising:

forming part of a production tubing from the first tubing section and the second tubing section.

17. The method of claim 14, further comprising:

forming part of a hydraulic conduit from the first conduit section and the second conduit section.

18. The method of claim 14, wherein the first conduit section receives a force tending to pull the end of the first conduit section away from the end of the second conduit section in response to movement of the engagement mechanism.

19. The method of claim 18, wherein the force comprises a frictional force.

20. The method of claim 14, wherein the first distance comprises a maximum distance in which a seal is maintained between the first conduit section and the second conduit section.

21. The method of claim 14, wherein the engagement mechanism comprises a sleeve, further comprising:

sliding the sleeve over the actuator of the latch to engage the latch.

22. A system comprising:

a first hydraulic conduit section;

a second hydraulic conduit section;

a first production tubing section;

a second production tubing section to mate with the first production tubing section;

a latch adapted to form a releasable connection between the first hydraulic conduit section and the second hydraulic conduit section in response to engagement of an actuator of the latch, the first hydraulic conduit section and the second hydraulic conduit section being substantially parallel to a longitudinal axis of the latch and the latch being adapted to maintain a first distance of separation between an end of the first hydraulic conduit section and an end of the second conduit section along the longitudinal axis; and an engagement mechanism attached to the first production tubing section and adapted to continuously engage the actuator to cause the latch to connect the first hydraulic conduit section and the second hydraulic conduit section despite movement of the production tubing section between a first position and a second position, wherein a second distance between the first position and the second position along the longitudinal axis is greater than the first distance, wherein one of the first hydraulic conduit section and the second hydraulic conduit section is not inserted into the other of the first hydraulic conduit section and the second hydraulic conduit section when the latch forms the connection between the first hydraulic conduit section and the second hydraulic conduit section.

23. The system of claim 22, wherein the first production tubing section forms a releasable connection with the second production tubing section when the latch connects the first hydraulic conduit section and the second hydraulic conduit section.

24. The system of claim 23, wherein the first production tubing section and the second production tubing section continuously maintain connection despite movement of the first production tubing section between the first position and the second position.

25. The system of claim 22, wherein the first hydraulic conduit section receives a force tending to pull the end of the first hydraulic conduit section away from the end of the second hydraulic conduit section in response to movement of the first production tubing section.

26. The system of claim 25, wherein the force comprises a frictional force.

27. The system of claim 22, wherein the first distance comprises a distance to maintain a seal integrity between the first hydraulic conduit section and the second hydraulic conduit section.

28. The system of claim 22, wherein the first distance comprises approximately 0.025 inches.

29. The system of claim 22, wherein the actuator of the latch comprises:

at least one dog adapted to engage a locking feature of the first hydraulic conduit section in response to contact between said at least one dog and the engagement mechanism.

30. The system of claim 22, wherein the latch comprises: a female connector attached to the end of the second hydraulic conduit section and adapted to receive the first end of the first hydraulic conduit section.

* * * * *